US009028375B2

(12) United States Patent
Ho et al.

(10) Patent No.: US 9,028,375 B2
(45) **Date of Patent: *May 12, 2015**

(54) ABDOMEN EXERCISE MACHINE

(71) Applicants: Wei-Teh Ho, Taipei (TW); Willy Ho, Taipei (TW); Michael Edward Casey, Austin, TX (US)

(72) Inventors: Wei-Teh Ho, Taipei (TW); Willy Ho, Taipei (TW); Michael Edward Casey, Austin, TX (US)

( * ) Notice: Subject to any disclaimer, the term of this patent is extended or adjusted under 35 U.S.C. 154(b) by 192 days.

This patent is subject to a terminal disclaimer.

(21) Appl. No.: 13/750,868

(22) Filed: Jan. 25, 2013

(65) Prior Publication Data

US 2014/0005007 A1 Jan. 2, 2014

Related U.S. Application Data

(63) Continuation-in-part of application No. 13/540,447, filed on Jul. 2, 2012, now Pat. No. 8,814,763.

(51) Int. Cl.

| | |
|---|---|
| ***A63B 21/062*** | (2006.01) |
| ***A63B 21/00*** | (2006.01) |
| ***A63B 22/14*** | (2006.01) |
| ***A63B 22/20*** | (2006.01) |
| ***A63B 23/02*** | (2006.01) |
| ***A63B 21/068*** | (2006.01) |
| *A63B 22/00* | (2006.01) |
| *A63B 23/035* | (2006.01) |
| *A63B 71/02* | (2006.01) |

(52) U.S. Cl.

CPC ..... *A63B 21/00* (2013.01); *A63B 21/1488* (2013.01); *A63B 22/0087* (2013.01); *A63B 22/14* (2013.01); *A63B 22/205* (2013.01); *A63B 23/02* (2013.01); *A63B 23/0216* (2013.01); *A63B 23/03525* (2013.01); *A63B 23/03533* (2013.01); *A63B 2208/0219* (2013.01); *A63B 22/203* (2013.01); *A63B 21/068* (2013.01); *A63B 23/0227* (2013.01); *A63B 2071/025* (2013.01); *A63B 21/00069* (2013.01)

(58) Field of Classification Search

CPC ..... A63B 21/068; A63B 22/201
USPC ..... 482/51, 70–72, 95, 96, 131–133, 135, 482/140, 92, 93, 142; D21/686–690

See application file for complete search history.

(56) References Cited

U.S. PATENT DOCUMENTS

| | | | | |
|---|---|---|---|---|
| 6,514,180 | B1 * | 2/2003 | Rawls | 482/70 |
| 7,485,079 | B2 * | 2/2009 | Brown et al. | 482/140 |
| 7,662,076 | B1 * | 2/2010 | Ho | 482/130 |
| 7,878,957 | B1 * | 2/2011 | Chen | 482/140 |
| 7,981,005 | B1 * | 7/2011 | Tsai | 482/51 |
| 8,043,199 | B1 * | 10/2011 | Barker | 482/140 |

(Continued)

*Primary Examiner* — Stephen Crow
*Assistant Examiner* — Nyca T Nguyen
(74) *Attorney, Agent, or Firm* — Blakely Sokoloff Taylor Zafman LLP

(57) ABSTRACT

An exercise machine applicable for strengthening users abdominal muscles is described. The machine can include a track frame and a support frame adjustably coupled to the track frame. The track frame can include a pair of parallel rails to provide gliding support for movement along the parallel rails. Two sliding assembly may be movably mounted on the parallel rails respectively. Each sliding assembly may be configurable to move together or separately along the parallel rails. Two seat pads may be adjustably secured to the two sliding assembly respectively. Each seat pad may be rotationally adjustable to change angular relationship between the seat pad's longitudinal direction and movement direction along the parallel rails.

7 Claims, 16 Drawing Sheets

(56) References Cited

U.S. PATENT DOCUMENTS

2009/0018000 A1 1/2009 Brown et al.
2010/0227748 A1 9/2010 Campanaro et al.
2013/0065736 A1* 3/2013 Chen ..... 482/96
2013/0095981 A1* 4/2013 Chung-Ting et al. ..... 482/66

* cited by examiner

ABDOMEN EXERCISE MACHINE

CROSS REFERENCES TO RELATED APPLICATIONS

The present invention is a continuation-in-part of U.S. patent application Ser. No. 13/540,447 filed Jul. 2, 2012, now pending, and the disclosures of which are considered part of and are incorporated by reference in the disclosure of this application.

FIELD OF INVENTION

The present invention relates generally to physical training machines, and in particular, exercise machines structured for exercising the abdominal muscles of a user.

BACKGROUND

With the growing awareness of health problems caused by lack of exercise, popularity of exercising machines, such as stationary bicycles, treadmills, rowing machines, step climbing machines, etc., has been continuously increasing. Typically, these machines are designed to focus movements of specific parts of the body. For example, abdominal machines may be structured to induce body exercises to strengthen the abdominal muscles. Existing abdominal machines, however, are usually designed based on variations of sit-ups exercises. Effective abdominal exercises may require a combination of movements involving muscles of different parts of the body including the waist, legs, etc. Although there are many exercising machines practical for exercising different parts of the body, these multipurpose exercising machines are usually heavy and expensive devices.

Therefore, traditional abdomen machines are not versatile, effective and economic.

SUMMARY OF THE DESCRIPTION

An exercise machine applicable for strengthening a user's abdominal muscles can include a track frame having a pair of parallel rails to provide gliding support for movement along the parallel rails. The parallel rails can have a higher end and a lower end, the higher end elevated at a height above the lower end for steepness of the movement. A support frame can be adjustably coupled to the track frame at the lower end and the higher end to elevate the parallel rails. Two sliding assemblies may be movably mounted on the parallel rails respectively. Each sliding assembly may be configurable to move together or separately along the parallel rails. Two seat pads may be adjustably secured to the two sliding assemblies respectively. Each seat pad may be rotationally adjustable to change angular relationship between the seat pad's longitudinal direction and movement direction along the parallel rails. Each seat pad may separately form a separate leg cushion to receive a leg position of a user to allow the user to move both legs in opposite directions along the parallel rails. Alternatively, the seat pads may be attached together longitudinally aligned to form a knee cushion to receive a kneeling position of the user towards the longitudinal direction of the seat pad to force the user to move and kneel in angular directions to impose a twisting effect on the user.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
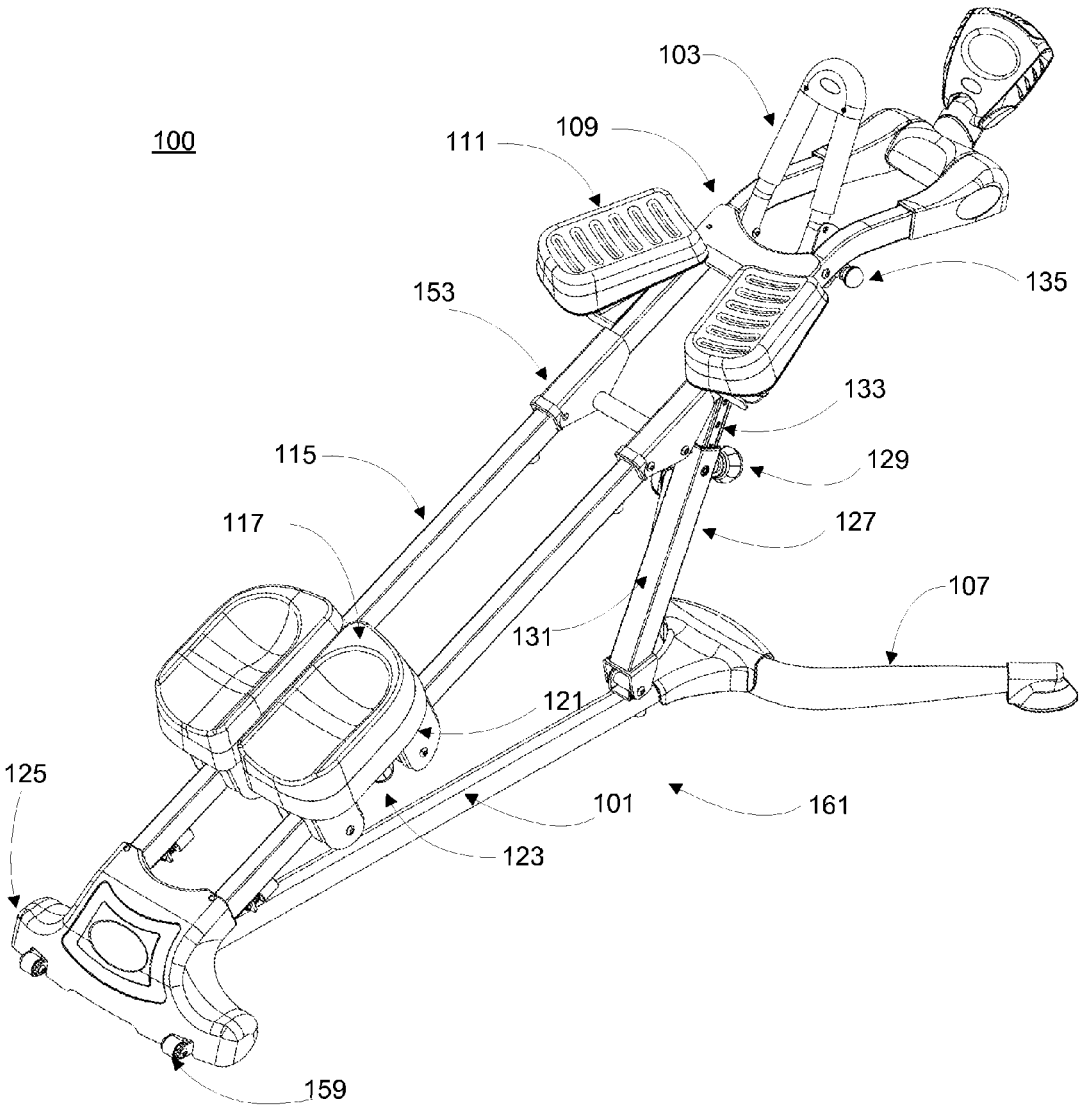
FIG. 1 is a perspective view of an embodiment of an exercise machine assembly.

FIG. 1 is a perspective view of an embodiment of an exercise machine assembly. Exercise machine (or device) 100 can include a track frame having a pair of resting bars 109 and a pair of elongated gliding rails 115 disposed in parallel. The track frame can have a lower end and a higher end supported by a support frame. For example, resting bars 109 may be pivotally coupled with the support frame at the higher end of the track frame. Gliding rails 115 may be pivotally affixed to the support frame at the lower end of the track frame.

In one embodiment, two mounting assemblies 121 (e.g. a first one and a second one) may be movably mounted on elongated gliding rails 115 respectively. Each mounting assembly 121 is capable of gliding along the corresponding gliding rail 115 up and down between the higher end and the lower end of the track frame.

Knee pad 117 may be mounded on top of each mounting assembly 121. Adjustment knob 123 may be provided to allow rotational adjustment of knee pad 117 over the mounting surface of mounting assembly 121. For example, knee pad 117 can be rotated relative to mounting assembly 121 with respect to an axis that is perpendicular to an axis along a corresponding elongated gliding rail 115. As a result, knee pad 117 may face a direction not aligned with movement direction of mounting assembly 121 when gliding up and down along the corresponding elongated gliding rail 115.

In one embodiment, each knee pad 117 may be formed in a shape suitable to receive knees of a user while the user is positioned facing the higher end of the track frame to allow the user to move both knee pads 117 separately in different directions or together in the same direction. Alternatively, both knee pads (or seat pads) 117 may be attached to form a seat to allow the user to sit thereon and to rest user's feet at the lower end of the track frame while gliding along gliding rails 115.

In one embodiment, two resting bars 109 may be detachably coupled with two elongated gliding rails 115 respectively via, for example, latch 153. Thus, different sizes (or lengths) of gliding rails may be adapted to accommodate, for example, different users or usage requirements related to strenuousness of the exercise movement. Each resting bar may be aligned with a corresponding gliding rail coupled. The track frame and the support frame may be coupled at the higher end of the track frame via resting bars 109.

Two elbow pads 111 may be fixedly attached to resting bars 109 respectively. Each elbow pad 111 may have an elbow cushion to receive an elbow of a user of exercise machine 100 to move along the track frame. Handlebar 103 may be adjustably mounted on resting bars 109 to support hand holding from the user with elbows resting on elbow pads 111. Handlebar 103 may have two ends fixedly positioned on separate resting bars 109. Adjustment of handlebar 103, for example, via adjustment knob 135, may allow rotating handlebar 103 around an axis formed by the two ends of handlebar 103 to change distances between handlebar 103 and elbow pads 111.

In one embodiment, a support frame can include base assembly 161 and an extendable support bar 127 adjustably coupled to base assembly 161. Base assembly 161 may rest on a floor via front base 159 and rear base 107. Front base 159 and rear base 107 may be coupled with each other via base bar 101 affixed in between. In some embodiments, extendable support bar 127 may be longitudinally aligned along a plane substantially perpendicular (or vertical) to the floor.

The track frame may be pivotally mounted to front base 159 at the lower end of the track frame. The track frame may be longitudinally directed via track direction (or have a track longitudinal direction) between the lower end and the higher end of the track frame. Base assembly 161 can be longitudinally directed via a base direction (or have a base longitudinal direction) along the floor between front base 159 and the rear base 107. The track frame may be adjustably movable around front base 159 for an angle formed by the track direction and the base direction, e.g. between rails 115 and base bar 101. The angle may correspond to a desired height of the higher end of the track frame.

In some embodiments, the support frame may provide a lifting support for maintaining an elevated position (e.g. with a height) above a floor for the higher end of the track frame. For example, extendable support bar 127 may stand upwardly on base assembly 161 to provide lifting support to elevate the track frame. Extendable support bar 127 may be adjustably (e.g. having an adjustable length) affixed to the higher end of the track frame to achieve a desired height. As a result, the track frame can be tilted up (or inclined) while the lower end of the track frame resting substantially on the floor to enable exercise movement up and down the gliding rails 115. In some embodiments, the support frame may be adjustable to substantially flatten machine 100 between the lower end and the higher end of the track frame.

Extendable support bar 127 can include a lower section 131 and an upper section 133 pivotally coupled to the track frame and base assembly 161 separately. For example, lower section 131 may be movably attached to base bar 101 at the base end of extendable support bar 127. Upper section 133 may be adjustably affixed to the higher end of the track frame at the track end of extendable support bar 127. In some embodiments, lower section 131 can have an insert and a locking mechanism with adjustment knob 129. Upper section 133 can have a series of longitudinally spaced apertures to selectively engage with lower section 131 inside the insert at one of the apertures via the locking mechanism according to a desired height at the higher end of the track frame.

In some embodiments, exercise machine 100 may include a track frame having a pair of parallel rails 115 to provide gliding support for movement along the parallel rails. Parallel rails 115 may have a higher end and a lower end. The higher end may be elevated at a height above the lower end for steepness of the movement. Additionally, exercise machine 100 may include a support frame adjustably affixed to the track frame at the lower end and higher end of the track frame. The support frame can provide elevation of the height for the parallel rails 115.

Two sliding assemblies 121 may be movably mounted on the parallel rails 115 respectively. Sliding assemblies 121 may be configurable to move together or separately along parallel rails 115. Optionally or additionally, two seat pads 117 may be adjustably secured to sliding assemblies 121 respectively. Each seat pad 117 can have a longitudinal direction. Each seat pad 117 may be rotationally adjustable to change angular relationship between the longitudinal direction and movement direction along the parallel rails 115.

In some embodiments, each seat pad (or knee pad) 117 can separately form a leg cushion to receive a leg position of a user of exercise machine 100 to allow the user to move both legs in opposite directions along parallel rails 115. Alternatively, seat pads 117 may be attachable together longitudinally aligned to form a knee cushion to receive a kneeling position of the user towards the longitudinal direction. The angular relationship between the longitudinal direction of seat pads 117 and movement direction along parallel rails 115 can allow the user to move and kneel in different directions to impose a twisting effect to exercise abdomen related muscles.

In one embodiment, exercise machine 100 may include a holding frame to provide hand holding support for a user, a track frame to provide movement support for the user. Alternatively or optionally, exercise machine 100 may include a foot base 125 at lower end. The holding frame may include handlebar 103 and/or elbow pads 111.

FIGS. 2A-2B are exploded perspective views of embodiments of an exercise machine assembly as shown in FIG. 1A or 1B. Turning now to FIG. 2A, for example, mounting assembly, such as mounting assembly 121 of FIG. 1A, can include slide bracket 137 attached with one or more wheels (or rollers) 151 slidabe (or rollable) along elongated gliding rail 115. A coupling control mechanism via control knob 119 can fasten two sliding brackets 137 together or allow slide brackets 137 to be separated to configure corresponding mounting assemblies 121 to move together or separately along gliding rails 115.

Alternatively, moving assemblies 121 may be attachable together to form a single cushion with attached seat pads 117 rotationally adjusted to be aligned towards a common direction. For example, both seat pads 117 may face a floor direction to receive a resting or sitting position for the user to move both legs together along rails 115.

For example, the single cushion can be attached toward a common direction not aligned with movement direction along rails 115. As a result, the single cushion can receive a kneeling position from the user to move along rails 115 while imposing a twisting effect on the user. Optionally, the single cushion can be attached to align with the movement direction along rails 115 to receive a sitting position from the user to allow the user to rest both feet on foot base 125 for the movement.

Figure 2:
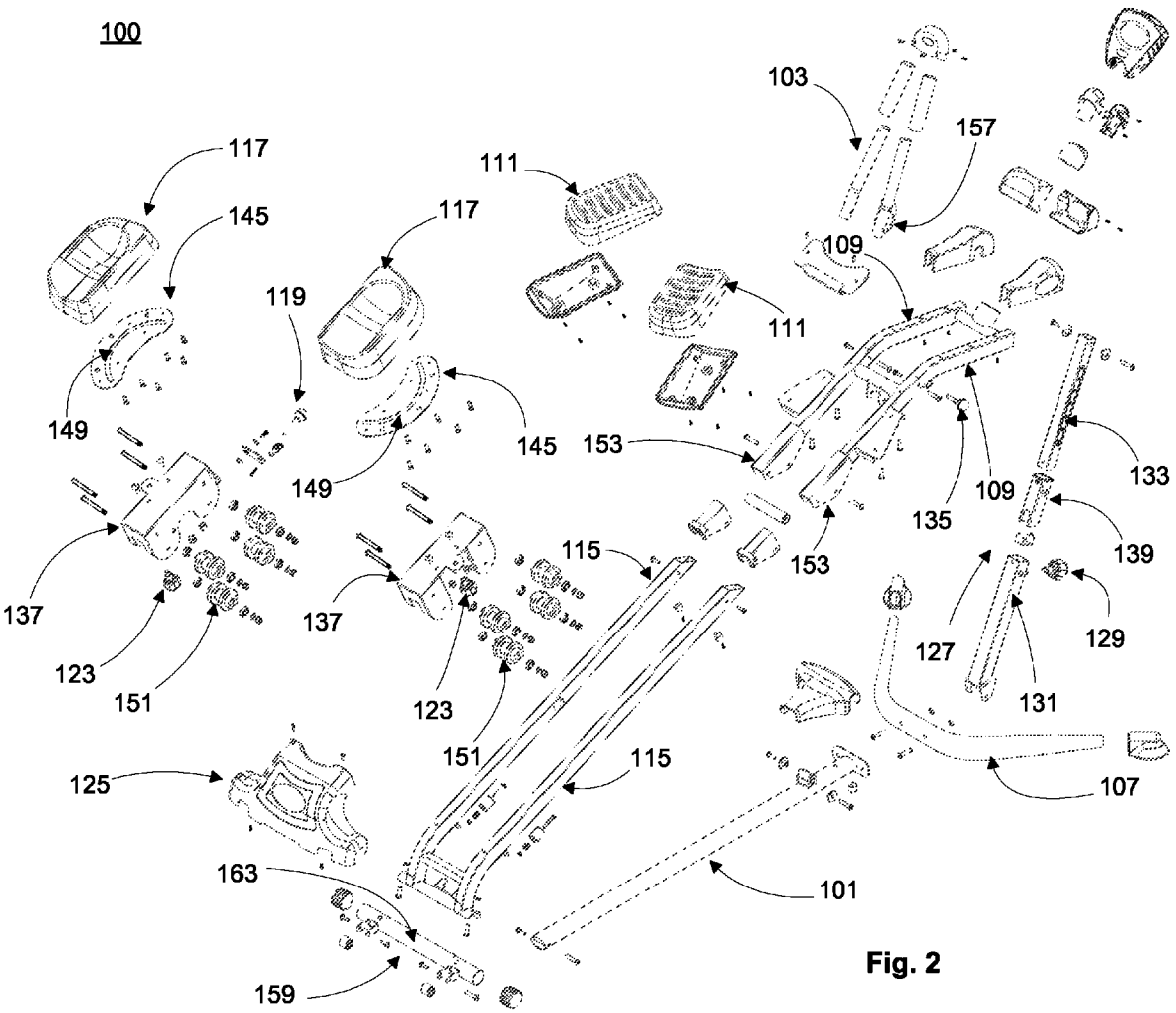
FIG. 2 is an exploded perspective view of an embodiment of an exercise machine assembly.

FIG. 2 is an exploded perspective view of an embodiment of an exercise machine assembly as shown in FIG. 1. For example, mounting assembly, such as mounting assembly 121 of FIG. 1, can include slide bracket 137 attached with one or more wheels 151 slidably attachable to elongated gliding rail 115. A coupling control mechanism via control knob 119 can fasten two sliding brackets 137 together or slide brackets 137 separated to configure corresponding mounting assemblies 121 to move together or separately along gliding rails 151.

In one embodiment, seat pad 117 may be affixed with plate 145 on an opposite side to surface of seat pad 117. Plate 145 may include a curved track 149 which can be a hollow cut to allow rotational or curved position adjustment over slide bracket 137. For example, seat pad 117 may be attached to slide bracket 137 with adjustment knob 123 secured in a position along curved track 149 to rotate seat pad 117 to a desired direction. Handle position plate 157 may be preconfigured with a number of engaging holes to receive knob 135 for adjusting rotational positions between handle bar 103 and resting bar 109.

According to one embodiment, front assembly 159 may include a floor rod 163. Real assembly 107 may include two base feet. Floor rod 163 together with the base feet of real assembly 107 may provide floor support for machine 100. In some embodiments, extendable support bar 127 may include a middle section 139 received within lower section 131 for adjustably coupling upper section 133 and lower section 131.

Figure 3:
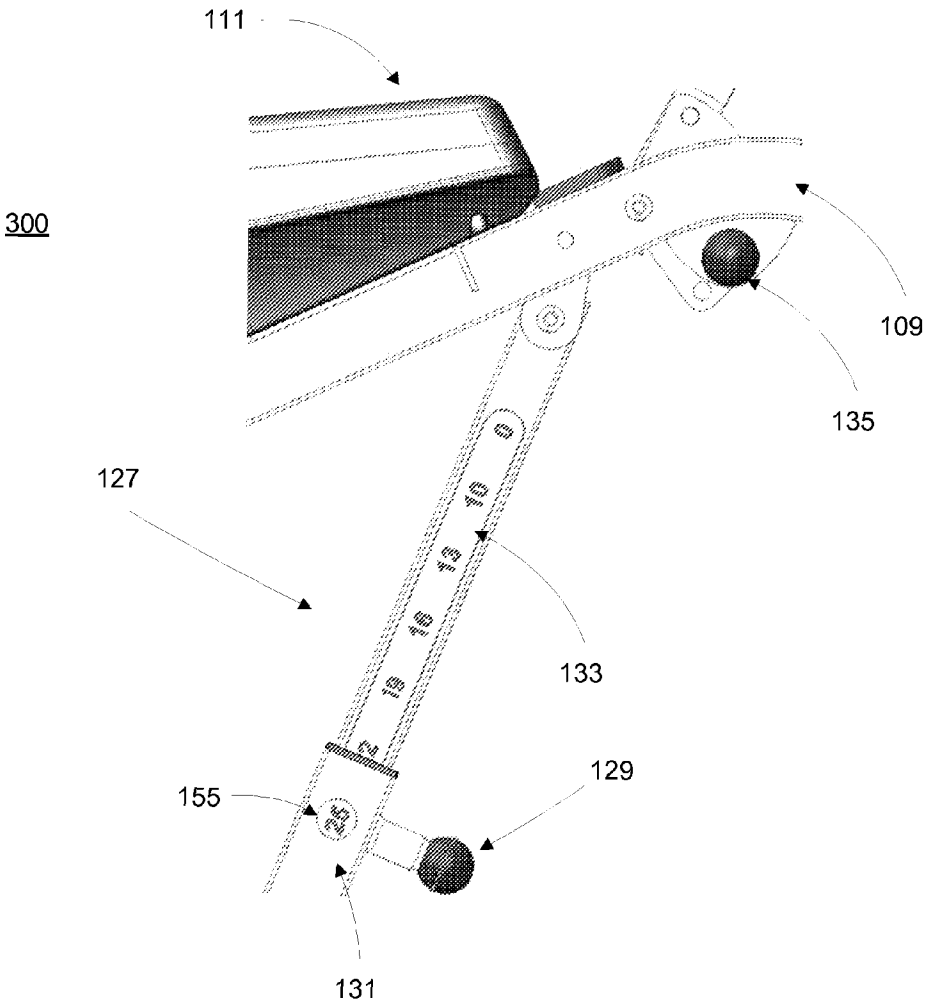
FIG. 3 illustrates an exemplary support structure configurable to support various height elevations for an exercise machine assembly.

FIG. 3 illustrates an exemplary support structure configurable to support various height elevations for an exercise machine assembly. For example, structure 300 may be used in machine 100 of FIG. 1. In one embodiment, extendable support bar 127 may include upper section 133 marked with preconfigured degrees or sizes indicating levels of elevation for the height of the track frame. Each mark can correspond to a separate length of extendable support bar 127 for an adjustable elevation of the track frame. For example, each mark may represent an angular size formed between base bar 101 and gliding rails 115 corresponding to the height of the track frame.

In some embodiments, lower section 131 may include an indicator opening 155 associated with a locking mechanism to define an amount of extension between lower section 131 and upper section 133 for adjusting the length of extendable support bar 127. For example, indicator opening 155 may allow marking 25 of upper sectional 133 to be visible to indicate an elevation of the track frame corresponding to a 25 degree angle formed between, for example, base bar 101 and gliding rails 115. In one embodiment, extendable support bar 127 may allow the track frame to be folded all together with base bar 101 and gliding rails 115 substantially parallel with each other (e.g. having 0 degrees of angle). Extendable support bar 127 may be configured to allow adjustments of elevation of the track frame via steps of common degrees of angular change (e.g. 4) to a maxim angular degree (e.g. 25). Other adjustment steps and ranges may be applicable.

Figure 4A:
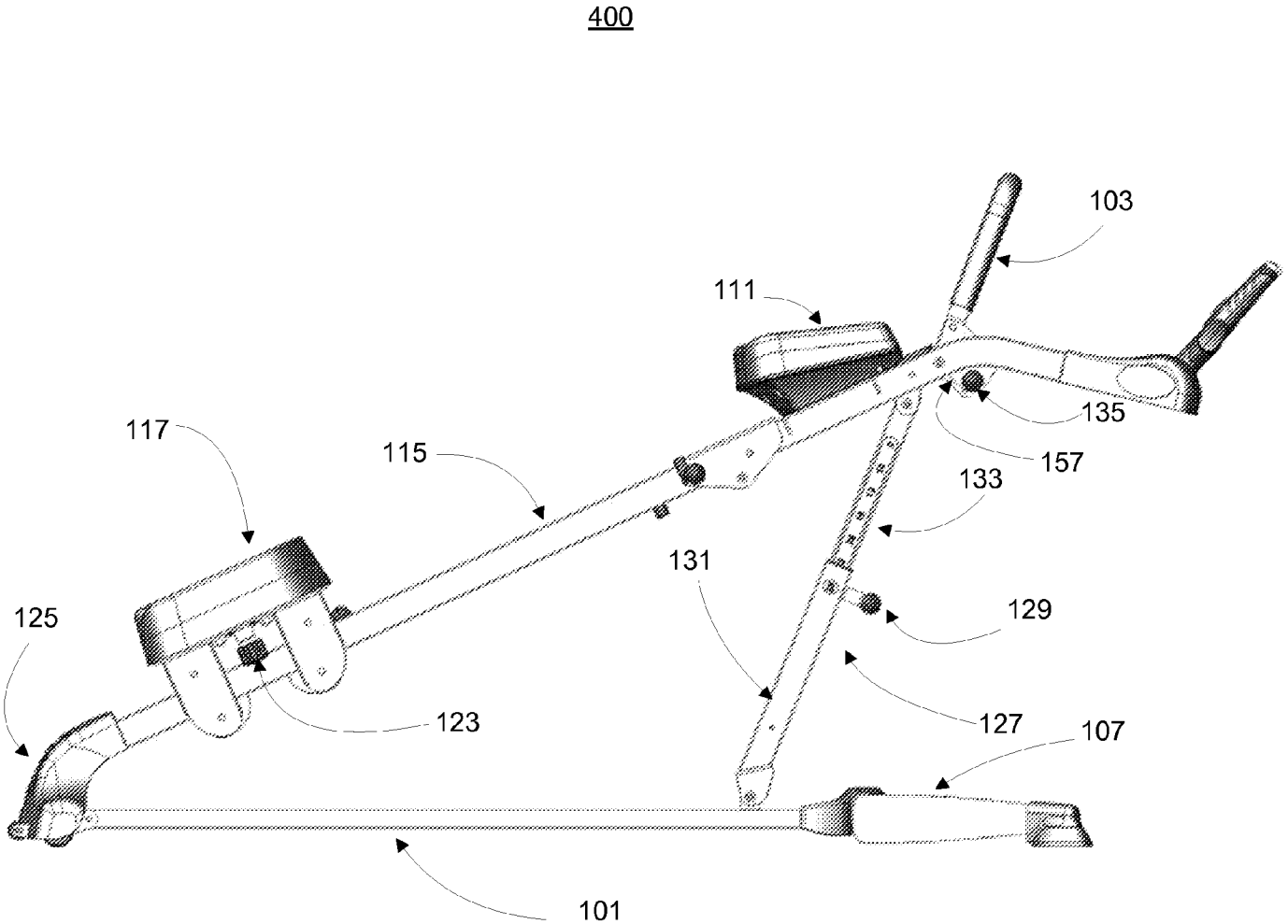
FIGS. 4A-4C show exemplary configurations for an exercise machine assembly with extended height elevations.
Figure 4B:
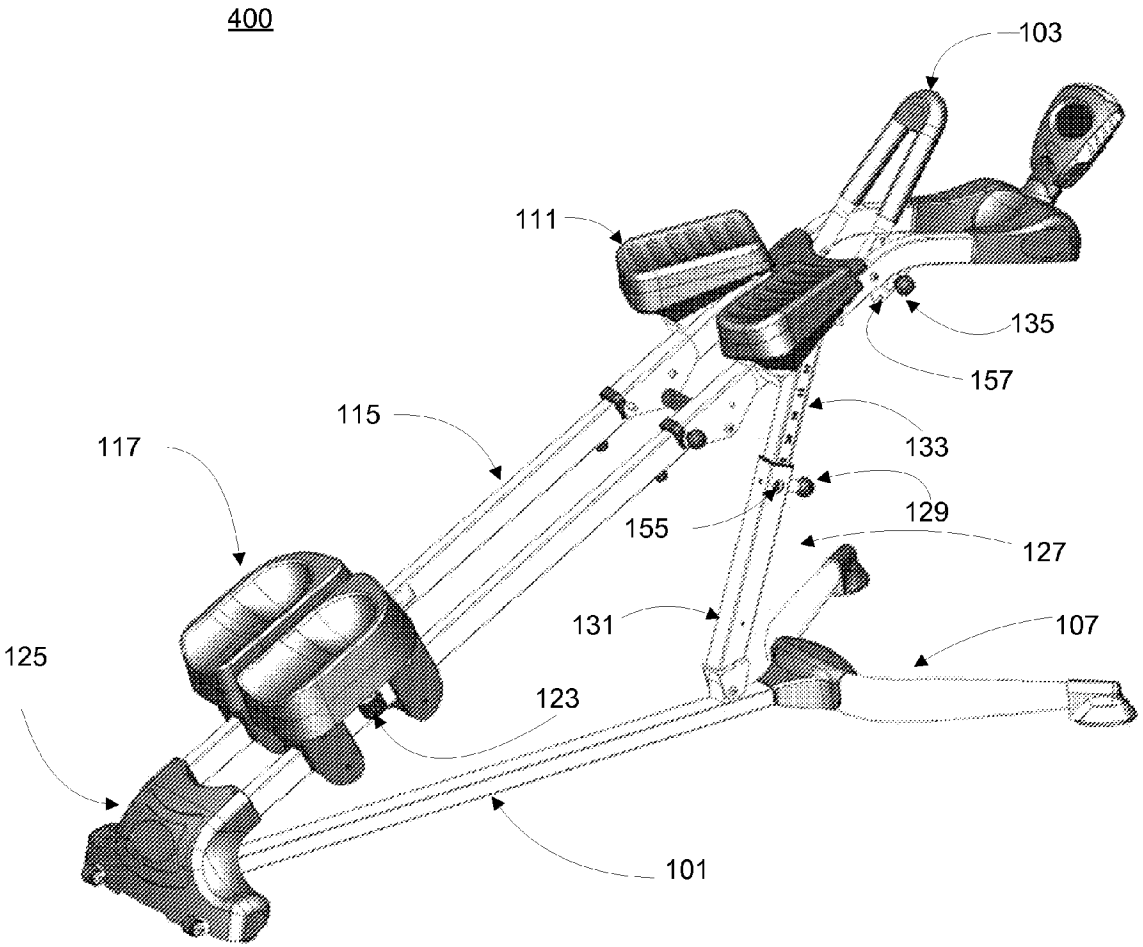
Figure 4C:
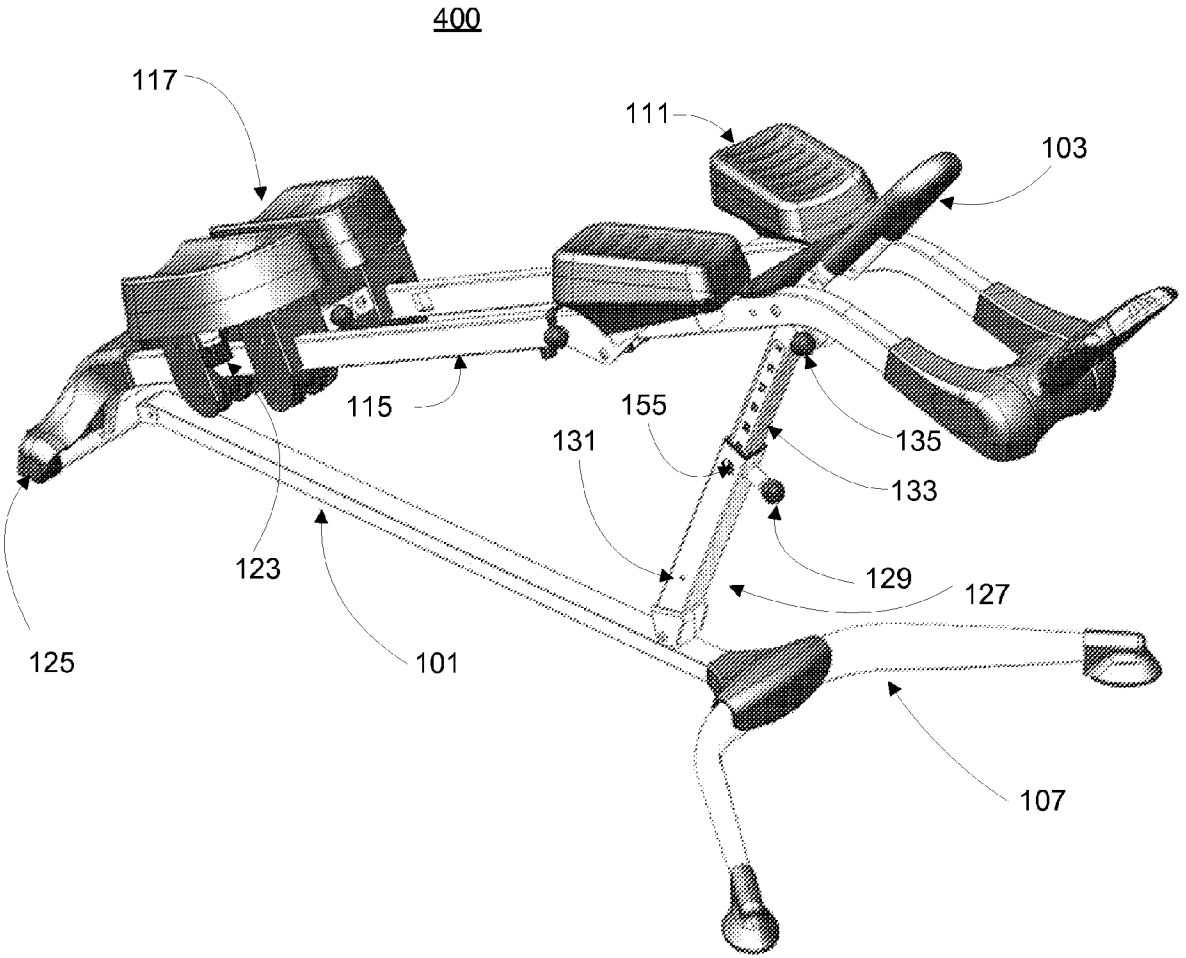

FIGS. 4A-4C show exemplary configurations for an exercise machine assembly with extended height elevations. For example, configuration 400 in FIGS. 4A-4C may correspond to a track frame elevated to a maximum allowable height according to adjustment of extendable support bar 127. In one embodiment, indicator opening 155 of lower section 131 may be aligned with a maximum marking (e.g. 25) marked on upper section 133.

Figure 5A:
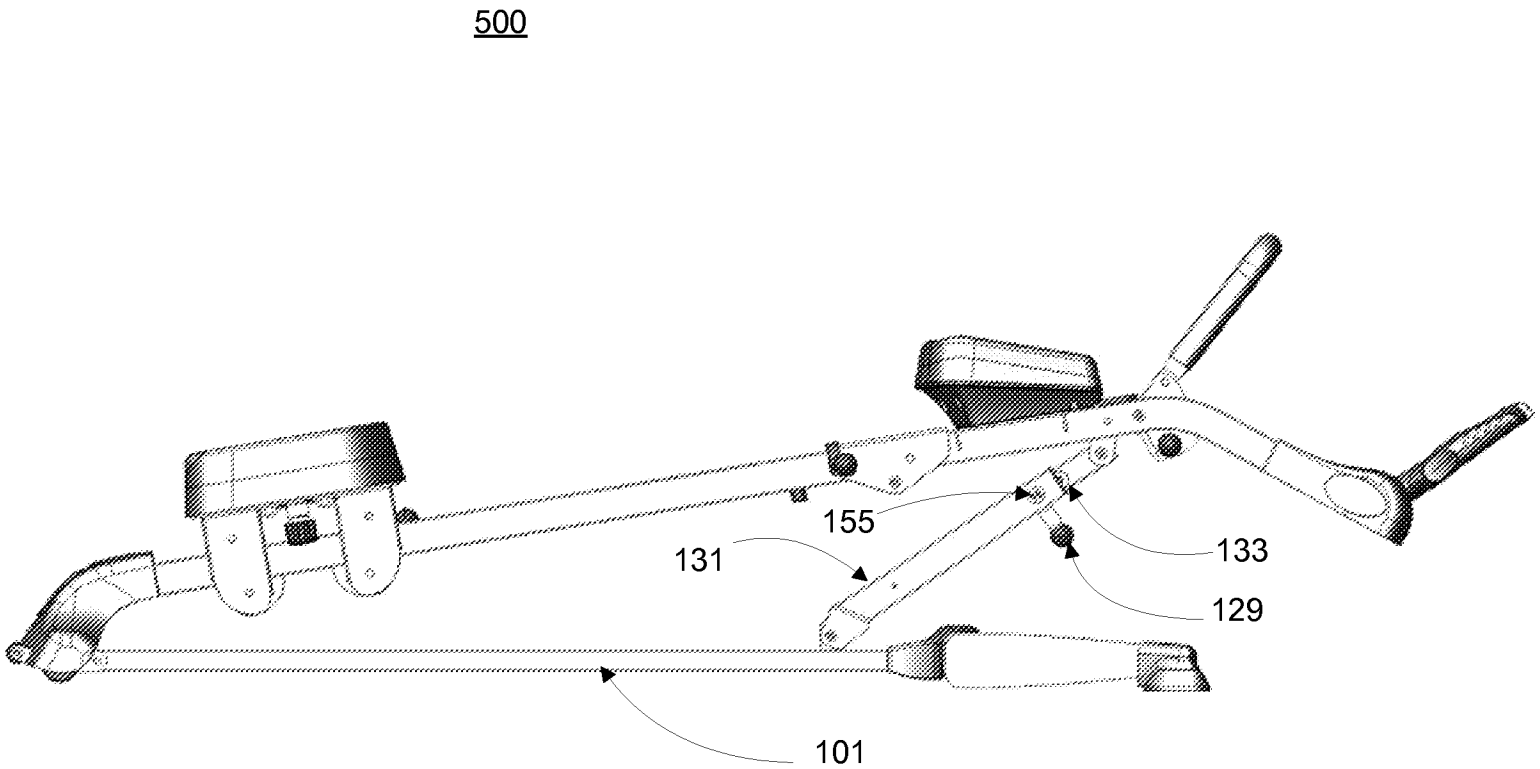
FIGS. 5A-5B show exemplary configurations for an exercise machine assembly with intermediate height elevations.
Figure 5B:
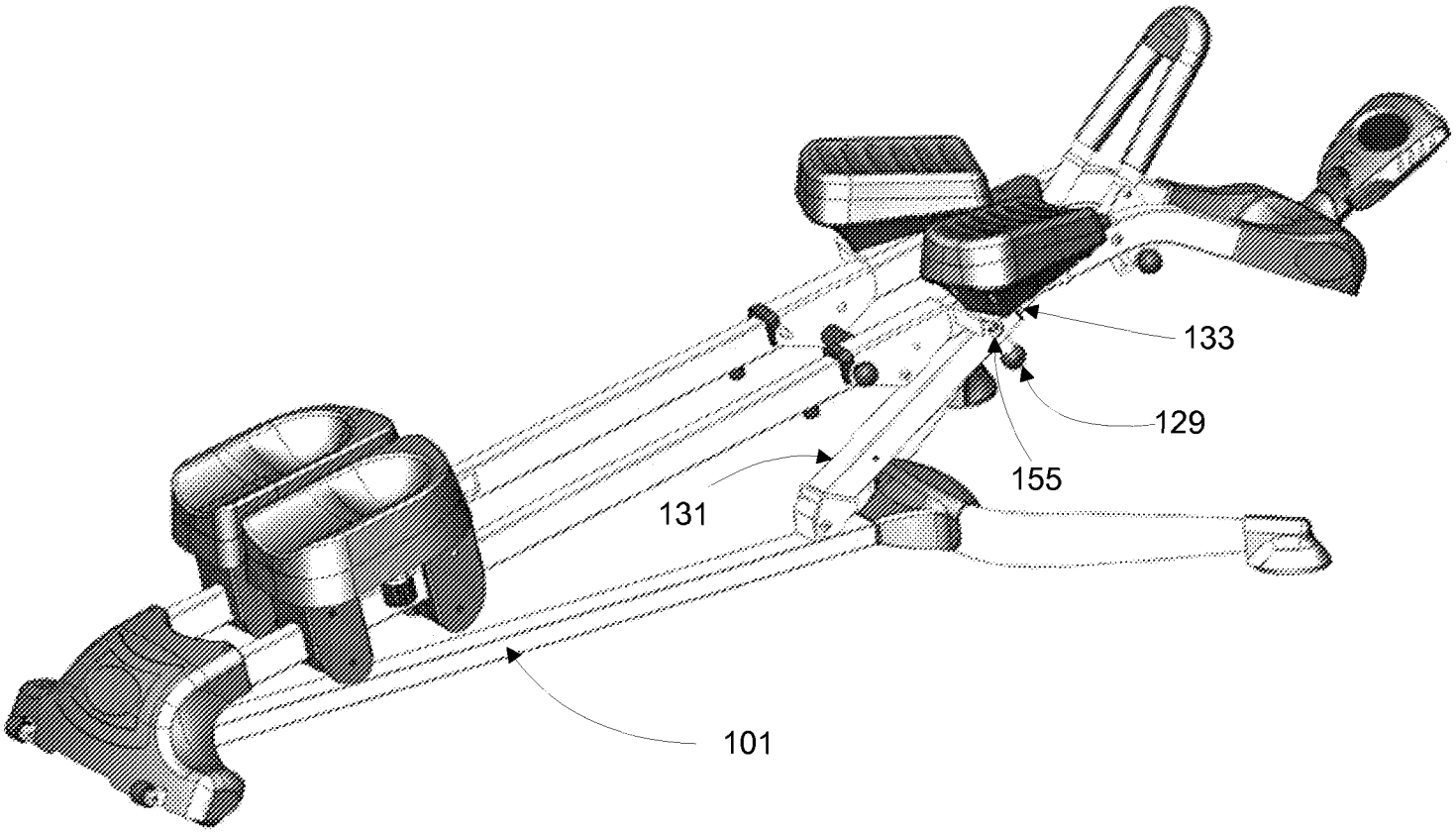

FIGS. 5A-5B show exemplary configurations for an exercise machine assembly with intermediate height elevations. For example, configuration 500 in FIGS. 5A-5B may correspond to a track frame elevated to an intermediate allowable height according to adjustment of extendable support bar 127. In one embodiment, indicator opening 155 of lower section 131 may be aligned with a marking (e.g. 10) indicating a value between a maximum allowable value (e.g. 25) and a minimum value (e.g. 0 marked on upper section 133

Figure 6A:
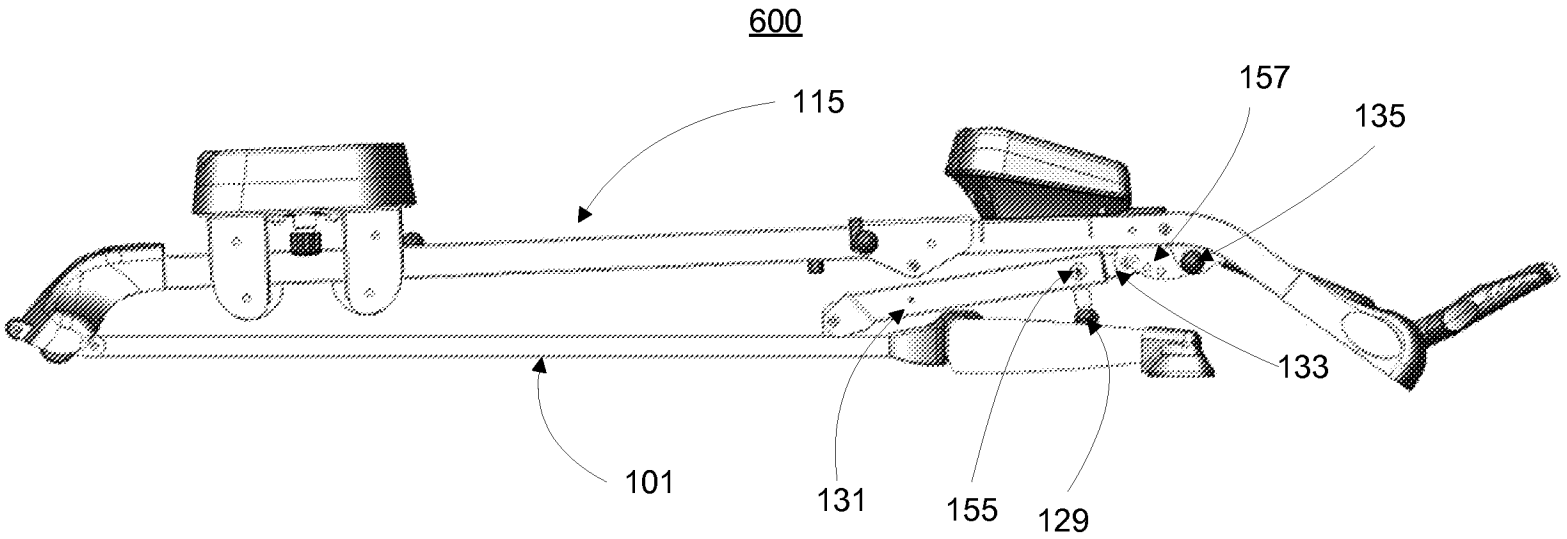
FIGS. 6A-6C show exemplary configurations for an exercise machine assembly with minimized height elevations.
Figure 6B:
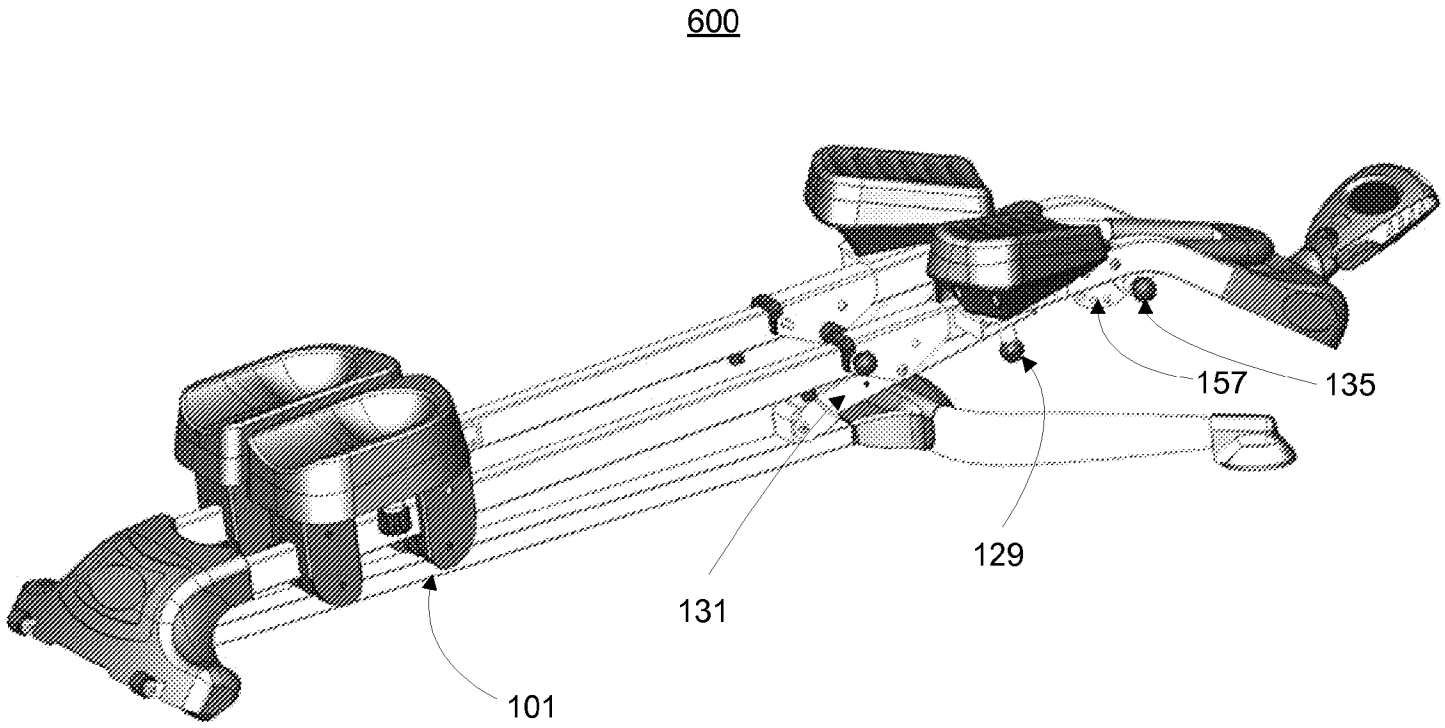
Figure 6C:
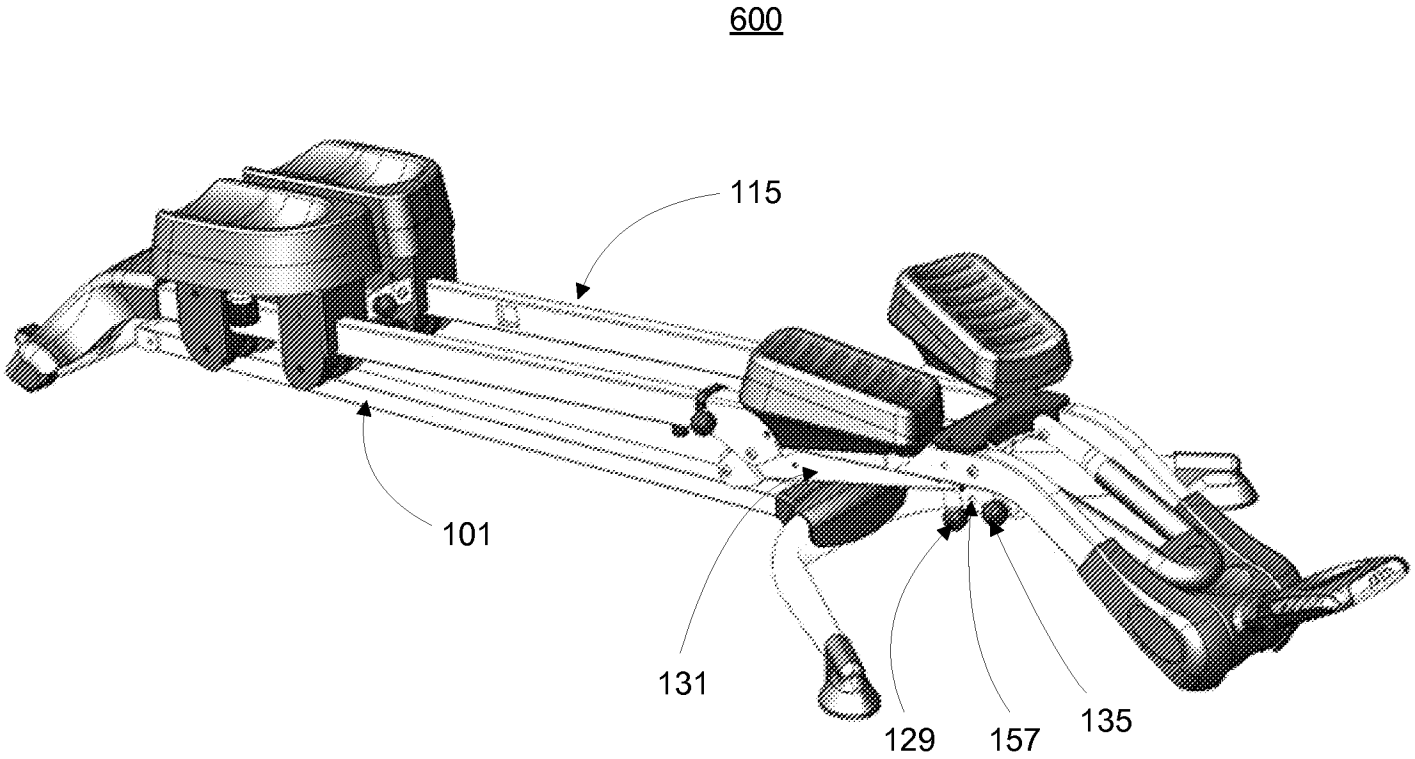

FIGS. 6A-6C show exemplary configurations for an exercise machine assembly with minimized height elevations. For example, configuration 600 in FIGS. 6A-6C may correspond to a track frame folded to a minimum elevation according to adjustment of extendable support bar 127. Base bar 101 and gliding rails 115 may be adjusted to be substantially parallel with each other. In one embodiment, indicator opening 155 of lower section 131 may be aligned with a minimum marking (e.g. 0) marked on upper section 133.

Figure 7A:
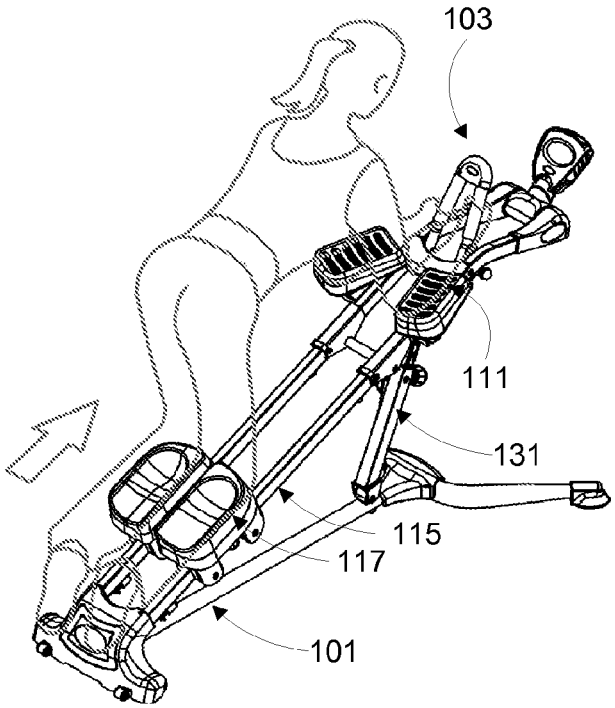
FIGS. 7A-7B show a first example of an application of the present invention.
Figure 7B:
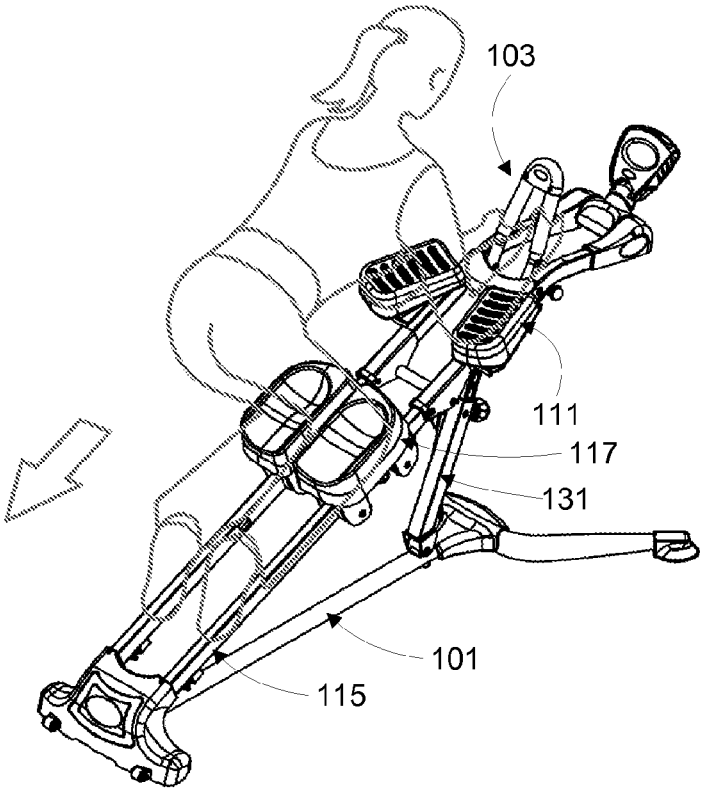

FIGS. 7A-7B show a first example of an application of the present invention. For example, the user can hold handlebar 103 with the both hands with elbows resting on elbow pads 111 and kneel on two knee pads 117 attached to move together. The user can alternatively contract and release the abdominal muscles to move knee pads 117 along sliding rails 115 simultaneously with the legs. Knee pads 117 can slide up along gliding rails 115 to substantially touch elbow pads 111 to bring the knees close to the elbows.

Figure 8A:
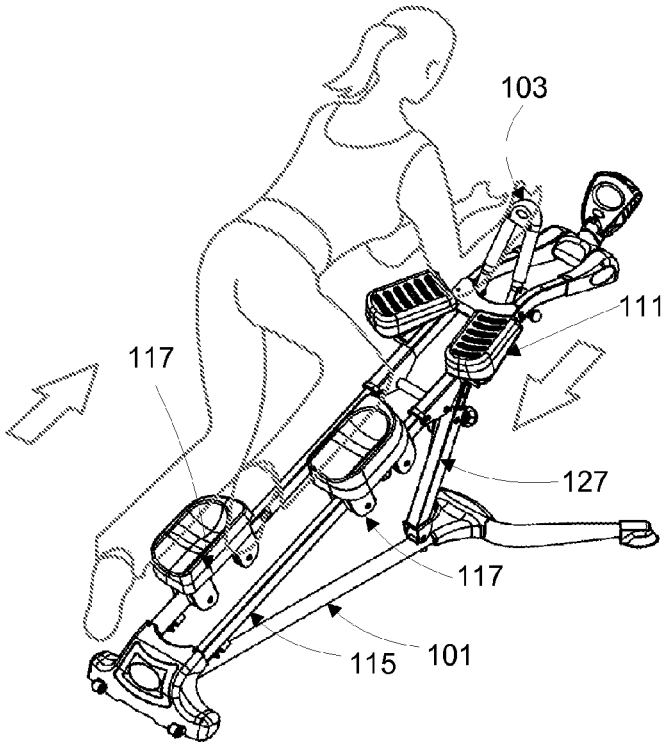
FIGS. 8A-8B show a second example of an application of the present invention.
Figure 8B:
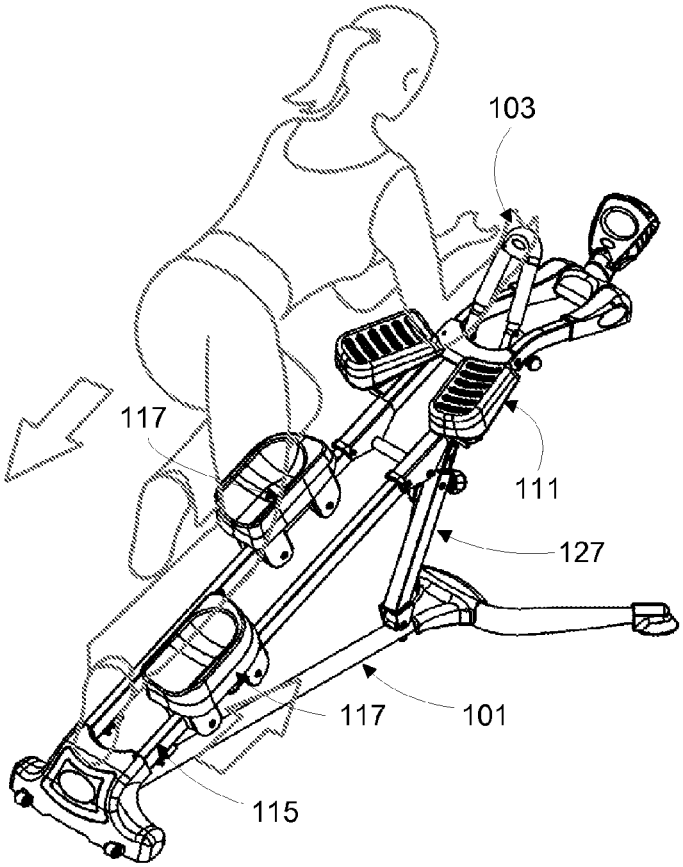

FIGS. 8A-8B show a second example of an application of the present invention. Similar to the application in FIGS. 3A-3B, the user can hold handlebar 103 with the both hands with elbows resting on elbow pads 111. Knee cushions or knee pads 117 are configured to be separately moveable. The user can put one knee on each seat cushion 117 separately and slide one leg forward all the way to touch or close in on the elbow on elbow pads 111 while the other leg sliding backward away from the elbow and alternatively repeat the back and forth movement along gliding rails 115.

Figure 9A:
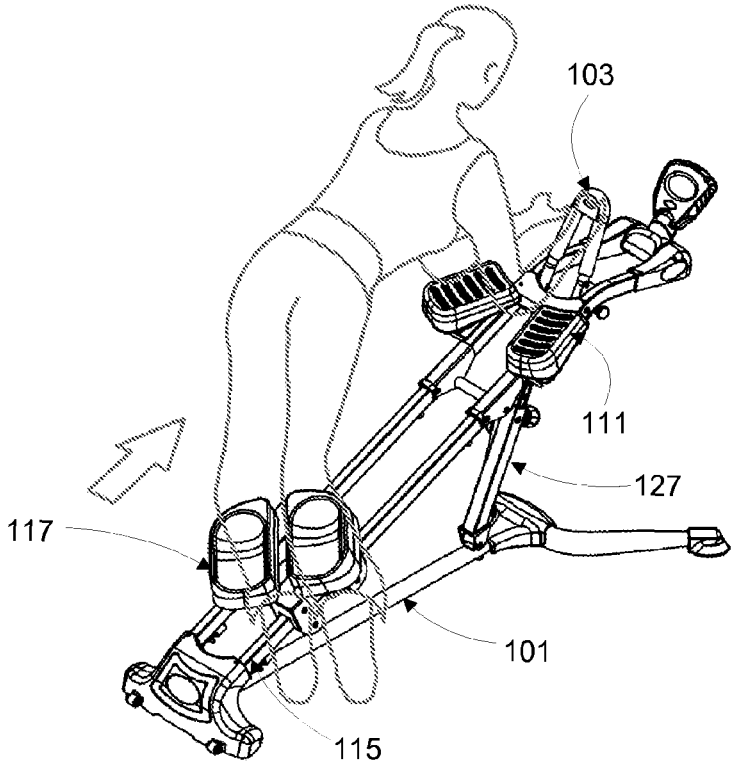
FIGS. 9A-9B show a third example of an application of the present invention.
Figure 9B:
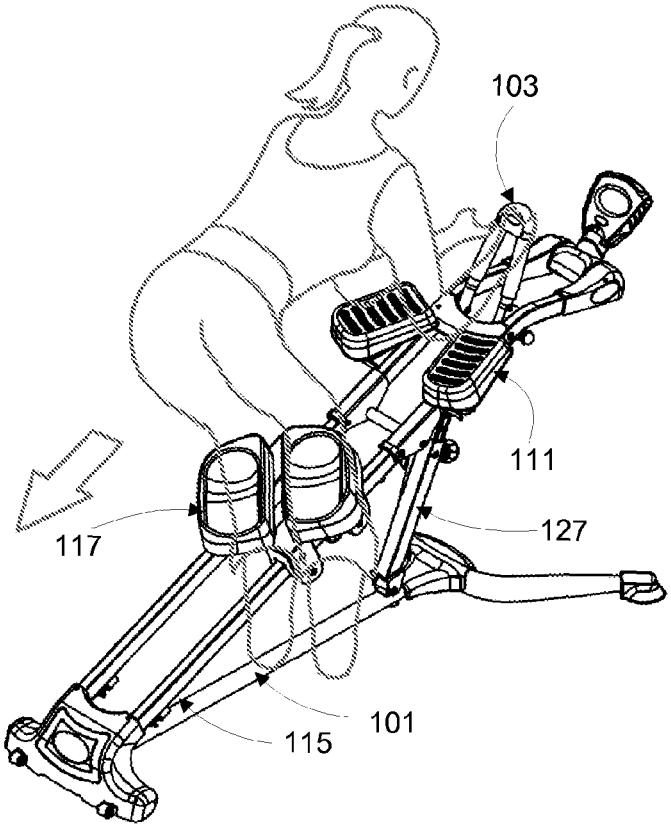

FIGS. 9A-9B show a third example of an application of the present invention. Similar to the application in FIGS. 7A-7B, the user kneels on two seat pads 117 attached to move together. Seat pads 117 are adjusted to rotate an angle towards left relative to movement direction along rails 115. As a result, a twisting effect can be imposed to abdomen related muscles of the user during movement along gliding rails 115.

Figure 10A:
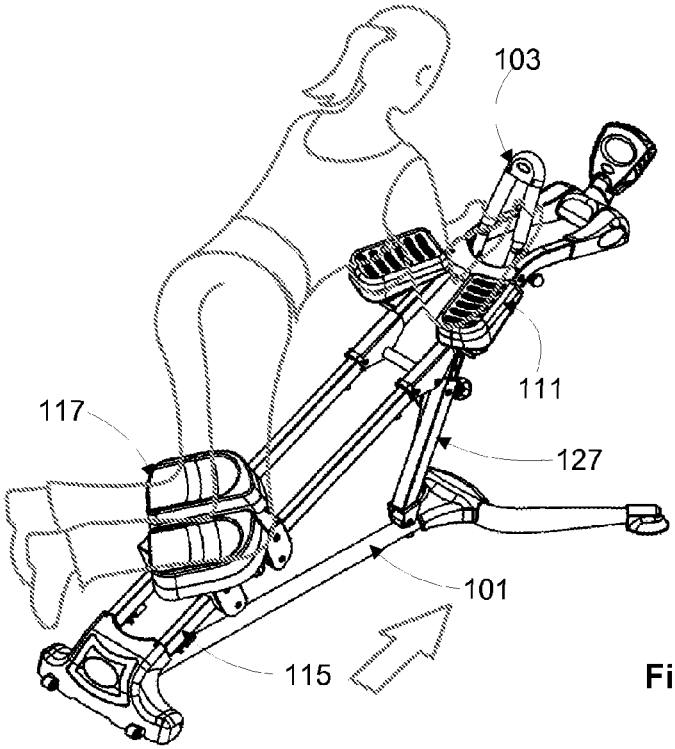
FIGS. 10A-10B show a fourth example of an application of the present invention.
Figure 10B:
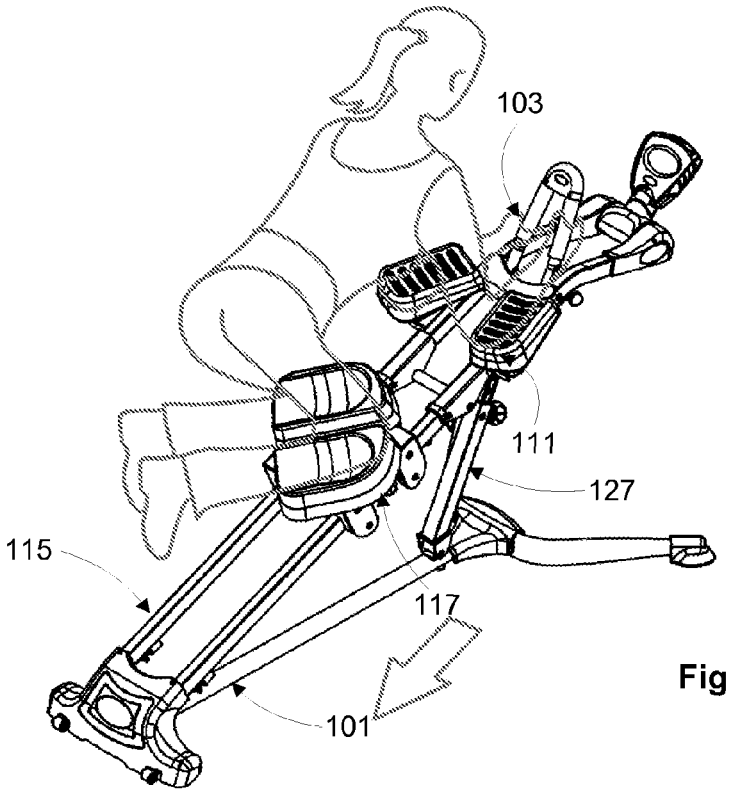

FIGS. 10A-10B show a fourth example of an application of the present invention similar to the application in FIGS.

5A-5B. Seat cushions 117 are rotated to the right to twist user's muscles in a different direction than the application in FIGS. 5A-5B.

Figure 11A:
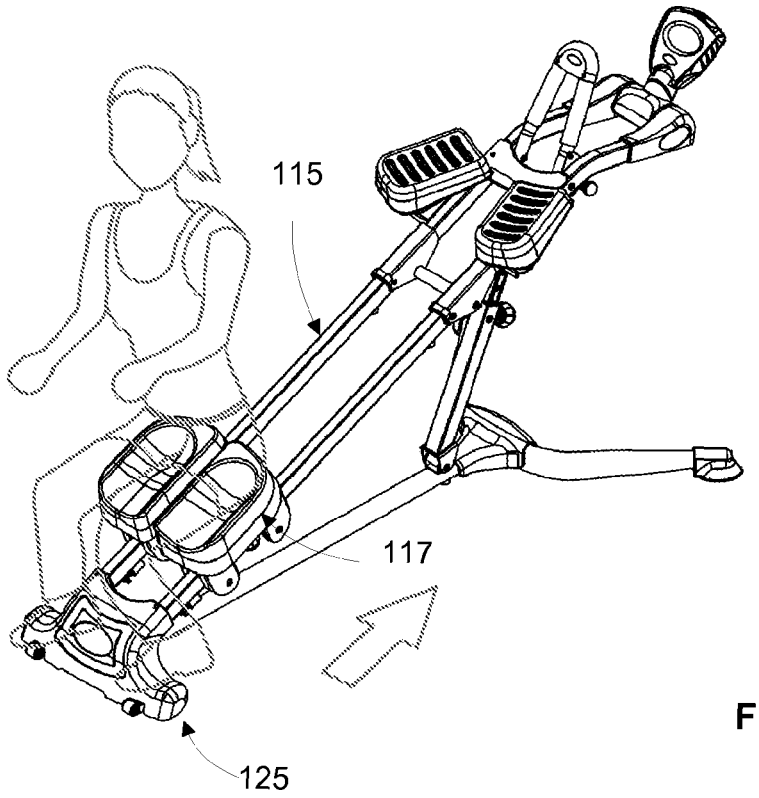
FIGS. 11A-11B show a fifth example of an application of the present invention.
Figure 11B:
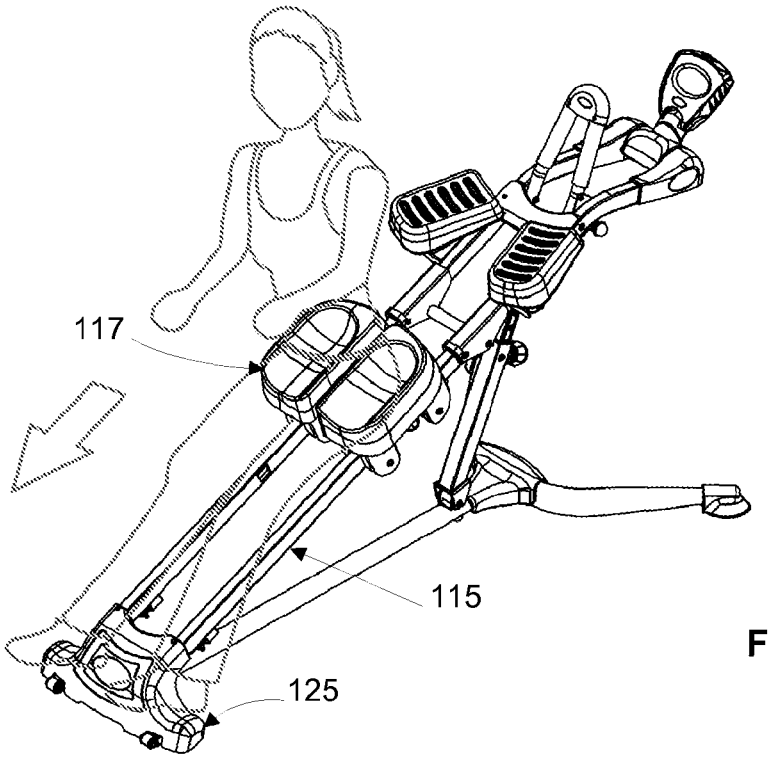

FIGS. 11A-11B show a fifth example of an application of the present invention. The user can sit on seat pads 117 attached to move together. The user can rest two feet on foot base 125 and then push and pull both legs to move seat pads 117 back and forth along gliding rails 115.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercise machine comprising:

a track frame having a first elongated gliding rail and a second elongated gliding rail in parallel, the track frame including a higher end and a lower end;

a support frame adjustably coupled to the track frame at the lower end and the higher end to provide support for the exercise machine, the support frame causing the track frame to be inclined from the lower end resting on a floor to a desired height of the higher end above the floor;

a first mounting assembly and a second mounting assembly movably mounted on the first and second elongated gliding rails, respectively, wherein the first and second mounting assemblies are capable of gliding along the first and second elongated gliding rails up and down between the higher end and the lower end of the track frame, wherein each mounting assembly mounted on one of the first and second elongated gliding rails comprises:

a slide bracket attached with one or more wheels slidably connected to the one elongated gliding rail, and a coupling control mechanism to allow configuration of the first and second mounting assemblies to move together or separately;

a first knee pad rotatably mounted on the first mounting assembly, wherein the first knee pad is capable of rotating relative to the first mounting assembly with respect to an axis that is perpendicular to an axis along the first elongated gliding rail while the first mounting assembly glides up and down along the first elongated gliding rail; and a second knee pad rotatably mounted on the second mounting assembly, wherein the second knee pad is capable of rotating relative to the second mounting assembly with respect to an axis that is perpendicular to an axis along the second elongated gliding rail while the second mounting assembly glides up and down along the second elongated gliding rail.

2. The exercise machine of claim 1, wherein the first and the second knee pads are formed in a shape suitable to receive knees of a user while the user is positioned facing the higher end of the track frame, and wherein the shape allows the user to sit thereon facing away from the higher end of the track frame with the user's feet resting at the lower end of the track frame.

3. The exercise machine of claim 1, wherein the support frame is adjustable to substantially flatten the machine between the lower end and the higher end of the track frame.

4. An exercising machine comprising:

a track frame having a first elongated gliding rail and a second elongated gliding rail in parallel, the track frame including a higher end and a lower end;

a support frame adjustably coupled to the track frame at the lower end and the higher end to provide support for the exercise machine, the support frame causing the track frame to be inclined from the lower end resting on a floor to a desired height of the higher end above the floor;

a first mounting assembly and a second mounting assembly movably mounted on the first and second elongated gliding rails, respectively, wherein the first and second mounting assemblies are capable of gliding along the first and second elongated gliding rails up and down between the higher end and the lower end of the track frame;

a first knee pad rotatably mounted on the first mounting assembly, wherein the first knee pad is capable of rotating relative to the first mounting assembly with respect to an axis that is perpendicular to an axis along the first elongated gliding rail while the first mounting assembly glides up and down along the first elongated gliding rail;

a second knee pad rotatably mounted on the second mounting assembly, wherein the second knee pad is capable of rotating relative to the second mounting assembly with respect to an axis that is perpendicular to an axis along the second elongated gliding rail while the second mounting assembly glides up and down along the second elongated gliding rail;

a first resting bar detachably coupled with the first elongated gliding rail, the first resting bar aligned with the first elongated gliding rail; and a second resting bar detachably coupled with the second elongated gliding rail, the second resting bar aligned with the second elongated gliding rail, wherein the track frame and the support frame are coupled at the higher end of the track frame via the first and second resting bars and wherein the resting bars are detachable from the elongated rails to allow adaptation of different sizes of the elongated rails.

5. The exercising machine of claim 4, further comprising:

two elbow pads fixedly attached to the first and second resting bars respectively, each elbow pad having an elbow cushion to receive an elbow of the user to cause the movement; and a handlebar adjustably mounted on the first and second resting bars to support hand holding from the user with elbows resting on elbow cushions of the elbow pads, the handlebar having two ends fixedly positioned separately on the first and second resting bars, adjustment of the handlebar to allow rotating the handlebar around an axis formed by the two ends to change distances between the handlebar and the elbow pads.

6. An exercise machine comprising:

a track frame having a first elongated gliding rail and a second elongated gliding rail in parallel, the track frame including a higher end and a lower end;

a support frame adjustably coupled to the track frame at the lower end and the higher end to provide support for the exercise machine, the support frame causing the track frame to be inclined from the lower end resting on a floor to a desired height of the higher end above the floor, wherein the support frame comprises a base assembly resting on the floor, the base assembly having a front base and a rear base, wherein the track frame is pivotally mounted to the front base at the lower end, the track frame longitudinally directed via a track direction between the lower end and the higher end, the base assembly longitudinally directed via a base direction along the floor between the front base and the rear base, the track frame movable around the front base for an angle formed by the track direction and the base direction, the angle corresponding to the desired height of the higher end, wherein the base assembly includes a base bar affixed to the front base and the rear base;

an extendable support bar having a base end and a track end, the base end pivotally affixed to the base bar, the track end pivotally affixed to the track frame at the higher end, the extendable support bar having an adjustable length to provide support for the desired height of the track frame;

a first mounting assembly and a second mounting assembly movably mounted on the first and second elongated gliding rails, respectively, wherein the first and second mounting assemblies are capable of gliding along the first and second elongated gliding rails up and down between the higher end and the lower end of the track frame;

a first knee pad rotatably mounted on the first mounting assembly, wherein the first knee pad is capable of rotating relative to the first mounting assembly with respect to an axis that is perpendicular to an axis along the first elongated gliding rail while the first mounting assembly glides up and down along the first elongated gliding rail; and a second knee pad rotatably mounted on the second mounting assembly, wherein the second knee pad is capable of rotating relative to the second mounting assembly with respect to an axis that is perpendicular to an axis along the second elongated gliding rail while the second mounting assembly glides up and down along the second elongated gliding rail.

7. The exercise machine of claim 6, wherein the extendable support bar comprises a lower section with the base end and an upper section with the track end, the lower section having an insert and a locking mechanism, the upper section having a series of longitudinally spaced apertures to selectively engage with the lower section inside the insert at one of the apertures via the locking mechanism accordingly to adjust the desired height for the track frame.

* * * * *